US007001143B2

(12) United States Patent
Vogiatzis

(10) Patent No.: US 7,001,143 B2
(45) **Date of Patent: *Feb. 21, 2006**

(54) CAMBERED VANE FOR USE IN TURBOCHARGERS

(75) Inventor: Costas Vogiatzis, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/795,075

(22) Filed: Mar. 5, 2004

(65) Prior Publication Data

US 2004/0170495 A1 Sep. 2, 2004

Related U.S. Application Data

(63) Continuation-in-part of application No. 10/236,281, filed on Sep. 5, 2002, now Pat. No. 6,709,232.

(51) Int. Cl.
*F01D 17/16* (2006.01)

(52) U.S. Cl. ..... 415/163; 415/164

(58) Field of Classification Search ..... 415/159–165, 415/186, 191, 208.2, 208.3, 208.5, 211.1, 415/208.1; 416/223 R, 223 A, 223 B, 242, 416/243, DIG. 2, DIG. 5; 60/602
See application file for complete search history.

(56) References Cited

U.S. PATENT DOCUMENTS

| | | | | |
|---|---|---|---|---|
| 3,495,921 A | | 2/1970 | Swearingen | |
| 4,242,040 A | | 12/1980 | Swearingen | |
| 4,300,869 A | | 11/1981 | Swearingen | |
| 4,629,396 A | | 12/1986 | Lorett | |
| 4,643,640 A | * | 2/1987 | Burdette et al. | 415/164 |
| 4,773,825 A | * | 9/1988 | Rodde et al. | 416/223 R |
| 4,804,316 A | * | 2/1989 | Fleury | 415/164 |
| 5,299,909 A | * | 4/1994 | Wulf | 415/208.3 |
| 5,318,249 A | | 6/1994 | Stoner | |
| 6,050,775 A | * | 4/2000 | Erdmann et al. | 415/164 |
| 6,264,429 B1 | * | 7/2001 | Koeller et al. | 416/223 A |
| 6,397,597 B1 | * | 6/2002 | Gartner | 60/602 |
| 6,457,938 B1 | * | 10/2002 | Liu et al. | 415/160 |
| 6,623,240 B1 | * | 9/2003 | Ertl et al. | 415/163 |
| 6,709,232 B1 | * | 3/2004 | Vogiatzis | 415/163 |

FOREIGN PATENT DOCUMENTS

| | | | | |
|---|---|---|---|---|
| CH | 316250 A | * | 11/1956 | 415/208.1 |
| EP | 1327749 A1 | | 7/2003 | |
| JP | 47-27845 A | * | 7/1972 | 416/242 |
| JP | 2000-45784 A | * | 2/2000 | 415/164 |
| JP | 2001263083 | | 9/2001 | |
| SU | 885571 A | * | 11/1981 | 415/191 |

* cited by examiner

OTHER PUBLICATIONS

Fukaya and Watanabe: "Compressible Turbulent Flow Analysis On Variable Nozzle Vane and Spacer in Turbocharger Turbine;" SAE International; Mar. 2000; pp. 1-7; Volume-issue No. 2000-02-0526; SAE Technical Paper Series, Warrendale, PA.*

*Primary Examiner*—Christopher Verdier
(74) *Attorney, Agent, or Firm*—Chris James

(57) ABSTRACT

Improved cambered vanes comprise an inner airfoil surface oriented adjacent a turbine wheel, and an outer airfoil surface oriented opposite the inner airfoil surface. The inner and outer airfoil surfaces define a vane airfoil thickness. A cambered vane leading edge or nose is positioned along a first inner and outer airfoil surface junction, and a vane trailing edge positioned along a second inner and outer surface junction. The vane airfoil surfaces, in conjunction with the vane leading edge, are specifically configured to provide a vane camberline, measured between the airfoil surfaces and extending along a length of the vane, having a gradually curved section and a substantially flat section.

11 Claims, 13 Drawing Sheets

| X | Y |
|---|---|
| .31079 | -.02068 |
| .32788 | -.02607 |
| .34386 | -.03117 |
| .35867 | -.03597 |
| .37226 | -.04043 |
| .38456 | -.04453 |
| .39554 | -.04824 |
| .40514 | -.05154 |
| .41333 | -.05440 |
| .42007 | -.05683 |
| .42511 | -.05952 |
| .42841 | -.06244 |
| .43005 | -.06529 |
| .43010 | -.06785 |
| .42861 | -.06994 |
| .42566 | -.07137 |
| .42134 | -.07197 |
| .41574 | -.07147 |
| .40887 | -.06993 |
| .40053 | -.06811 |
| .39074 | -.06611 |
| .37953 | -.06398 |
| .36695 | -.06177 |
| .35305 | -.05954 |
| .33787 | -.05732 |
| .32147 | -.05514 |
| .30393 | -.05304 |
| .28532 | -.05104 |
| .26572 | -.04916 |
| .24522 | -.04742 |
| .22392 | -.04585 |
| .20193 | -.04448 |
| .17936 | -.04334 |
| .15633 | -.04247 |
| .13296 | -.04191 |
| .10935 | -.04171 |
| .08563 | -.04190 |
| .06188 | -.04251 |
| .03819 | -.04355 |
| .01462 | -.04501 |
| -.00877 | -.04689 |
| -.03195 | -.04915 |
| -.05490 | -.05173 |
| -.07759 | -.05456 |
| -.10000 | -.05755 |
| -.12210 | -.06061 |
| -.14383 | -.06362 |
| -.16514 | -.06645 |
| -.18596 | -.06891 |
| -.20622 | -.07070 |
| -.22579 | -.07174 |
| -.24454 | -.07194 |
| -.26231 | -.07127 |
| -.27894 | -.06970 |
| -.29425 | -.06725 |
| -.30809 | -.06401 |
| -.32033 | -.06007 |
| -.33084 | -.05560 |
| -.33955 | -.05075 |
| -.34644 | -.04571 |
| -.35149 | -.04063 |
| -.35476 | -.03565 |
| -.35631 | -.03089 |
| -.35621 | -.02641 |
| -.35458 | -.02224 |
| -.35151 | -.01837 |
| -.34711 | -.01477 |
| -.34145 | -.01137 |
| -.33460 | -.00812 |
| -.32663 | -.00493 |
| -.31753 | -.00174 |
| -.30731 | .00154 |
| -.29593 | .00494 |
| -.28335 | .00851 |
| -.26950 | .01227 |
| -.25434 | .01621 |
| -.23783 | .02028 |
| -.21998 | .02442 |
| -.20079 | .02851 |
| -.18030 | .03239 |
| -.15863 | .03606 |
| -.13589 | .03944 |
| -.11221 | .04235 |
| -.08774 | .04463 |
| -.06263 | .04614 |
| -.03707 | .04678 |
| -.01123 | .04648 |
| .01473 | .04522 |
| .04064 | .04302 |
| .06635 | .03994 |
| .09174 | .03606 |
| .11671 | .03151 |
| .14117 | .02640 |
| .16504 | .02086 |
| .18826 | .01501 |
| .21077 | .00898 |
| .23252 | .00288 |
| .25346 | -.00321 |
| .27352 | -.00921 |
| .29265 | -.01505 |
| .31079 | -.02068 |

FIG. 11

CAMBERED VANE FOR USE IN TURBOCHARGERS

RELATION TO COPENDING PATENT APPLICATION

This patent application is a continuation-in-part of U.S. patent application Ser. No. 10/236,281 filed on Sep. 5, 2002, now U.S. Pat. No. 6,709,232 which is incorporated herein by reference.

FIELD OF INVENTION

This invention relates generally to the field of turbochargers and, more particularly, to an improved cambered design for vanes disposed within a variable geometry turbocharger for purposes of maximizing flow efficiency within the turbocharger.

BACKGROUND OF THE INVENTION

Turbochargers for gasoline and diesel internal combustion engines are devices known in the art that are used for pressurizing or boosting the intake air stream, routed to a combustion chamber of the engine, by using the heat and volumetric flow of exhaust gas exiting the engine. Specifically, the exhaust gas exiting the engine is routed into a turbine housing of a turbocharger in a manner that causes an exhaust gas-driven turbine to spin within the housing. The exhaust gas-driven turbine is mounted onto one end of a shaft that is common to a radial air compressor mounted onto an opposite end of the shaft and housed in a compressor housing. Thus, rotary action of the turbine also causes the air compressor to spin within a compressor housing of the turbocharger that is separate from the turbine housing. The spinning action of the air compressor causes intake air to enter the compressor housing and be pressurized or boosted a desired amount before it is mixed with fuel and combusted within the engine combustion chamber.

In a turbocharger it is often desirable to control the flow of exhaust gas to the turbine to improve the efficiency or operational range of the turbocharger. Variable geometry turbochargers (VGTs) have been configured to address this need. A type of such VGT is one having a variable or adjustable exhaust nozzle, referred to as a variable nozzle turbocharger. Different configurations of variable nozzles have been employed in variable nozzle turbochargers to control the exhaust gas flow. One approach taken to achieve exhaust gas flow control in such VGTs involves the use of multiple vanes, which can be fixed, pivoting and/or sliding, positioned annularly around the turbine inlet. The vanes are commonly controlled to alter the throat area of the passages between the vanes, thereby functioning to control the exhaust gas flow into the turbine.

The vanes are generally designed having an airfoil shape that is configured to both provide a complementary fit with adjacent vanes when placed in a closed position, and to provide for the passage of exhaust gas within the turbine housing to the turbine wheel when placed in an open position. It has been discovered that the airfoil shape of conventional vanes used in such application creates an undesired back-pressure within the turbine housing that does not contribute to the most efficient turbocharger operation.

It is, therefore, desired that the vanes for use with a variable geometry turbocharger be configured in a manner that minimizes any unwanted aerodynamic pressure effects within the turbine housing to facilitate and promote efficient turbocharger operation. It is also desired that such vanes be designed in a manner that facilities use of the same within variable geometry turbochargers with minimum adjustments or retrofit changes.

SUMMARY OF THE INVENTION

Improved cambered vanes of this invention are constructed for use within vaned turbochargers, including but not limited to a VGT. The VGT comprises a turbine housing having an exhaust gas inlet and an outlet, a volute connected to the inlet, and a nozzle wall adjacent the volute. A turbine wheel is carried within the turbine housing and is attached to a shaft. A plurality of such improved cambered vanes are movably disposed within the turbine housing between the exhaust gas inlet and turbine wheel.

Each improved cambered vane comprises an inner airfoil surface oriented adjacent the turbine wheel, and an outer airfoil surface oriented opposite the inner airfoil surface. The inner and outer airfoil surfaces define a vane airfoil thickness. A cambered vane leading edge or nose is positioned along a first inner and outer airfoil surface junction, and a vane trailing edge is positioned along a second inner and outer surface junction.

The vane inner and outer airfoil surfaces, in conjunction with the vane leading edge, are specially configured to provide a vane camberline, as measured between the airfoil surfaces and extending along a length of the vane, that has a gradually curved section and a substantially flat section. Vanes of this invention have characteristic camberlines that are flat for at least the first 5 percent of the vane length moving away from the vane leading edge.

Vanes configured in this manner have a leading edge and transitional outer and inner airfoil surfaces that reduce unwanted aerodynamic effects within the turbine housing by maintaining a constant rate of exhaust gas acceleration as exhaust gas is passed thereover, thereby reducing unwanted back-pressure within the turbine housing and increasing turbocharger and turbocharged engine operation.

BRIEF DESCRIPTION OF THE DRAWINGS

The invention will be more clearly understood with reference to the following drawings wherein:

FIG. 11 is a table of "x" and "y" coordinates for the vane profile illustrated in FIG. 10.

DETAILED DESCRIPTION OF THE INVENTION

The invention, constructed in accordance with the principles of this invention, comprises an improved cambered vane for use in a vaned turbocharger, including but not limited to a variable geometry turbocharger (VGT). For convenience, an exemplary embodiment using a VGT will be described throughout this specification. However, it will be readily understood by those skilled in the relevant technical field that the improved vane of the present invention could be used in a variety of turbocharger configurations, including fixed vane turbochargers and those of the sliding and/or pivoting vane type.

The vane is configured having a modified airfoil profile for purposes of minimizing unwanted aerodynamic effects within a turbine housing and improving turbocharger operating efficiency when compared to conventional vane designs.

Figure 1:
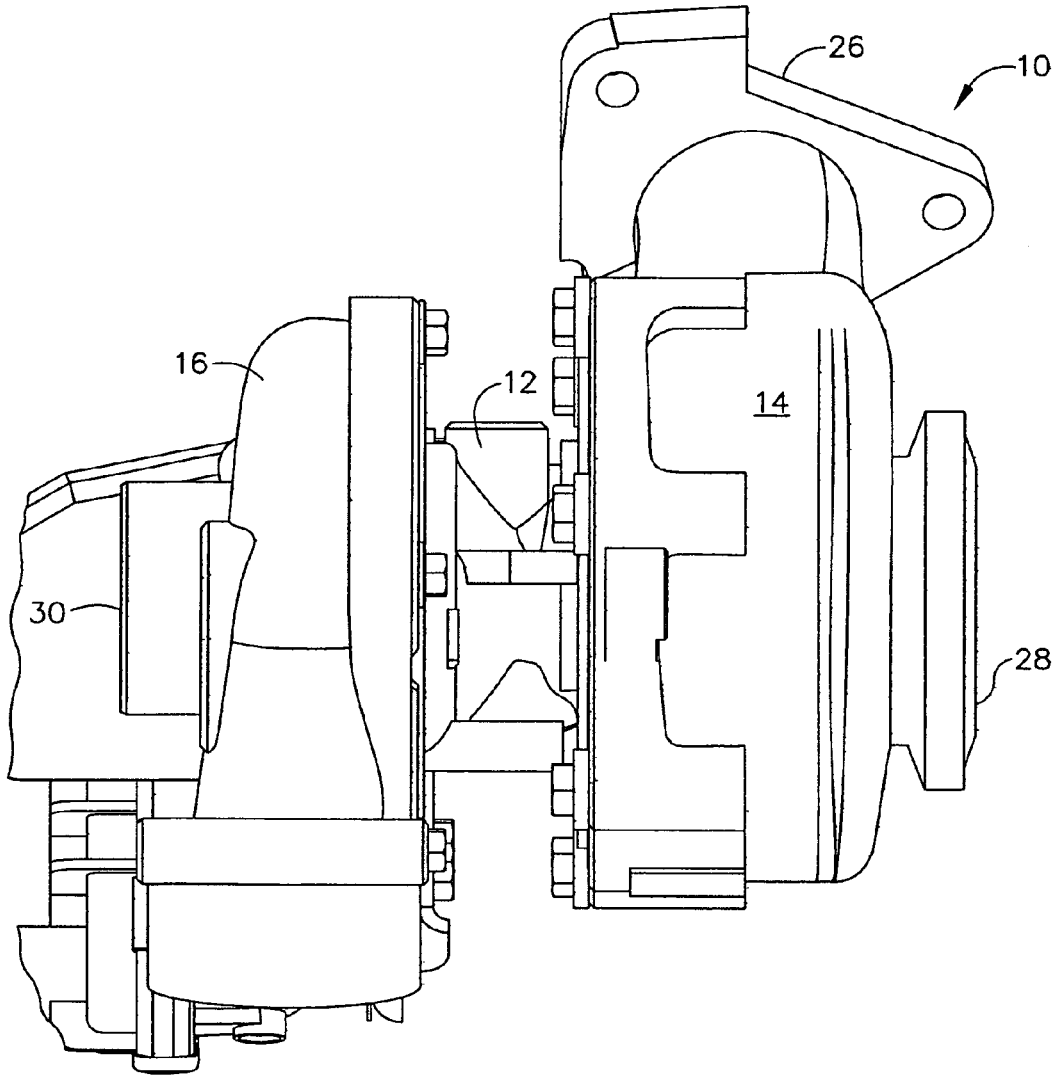
FIG. 1 is an elevational side view of a variable geometry turbocharger comprising a number of pivoting vanes of this invention.
Figure 2:
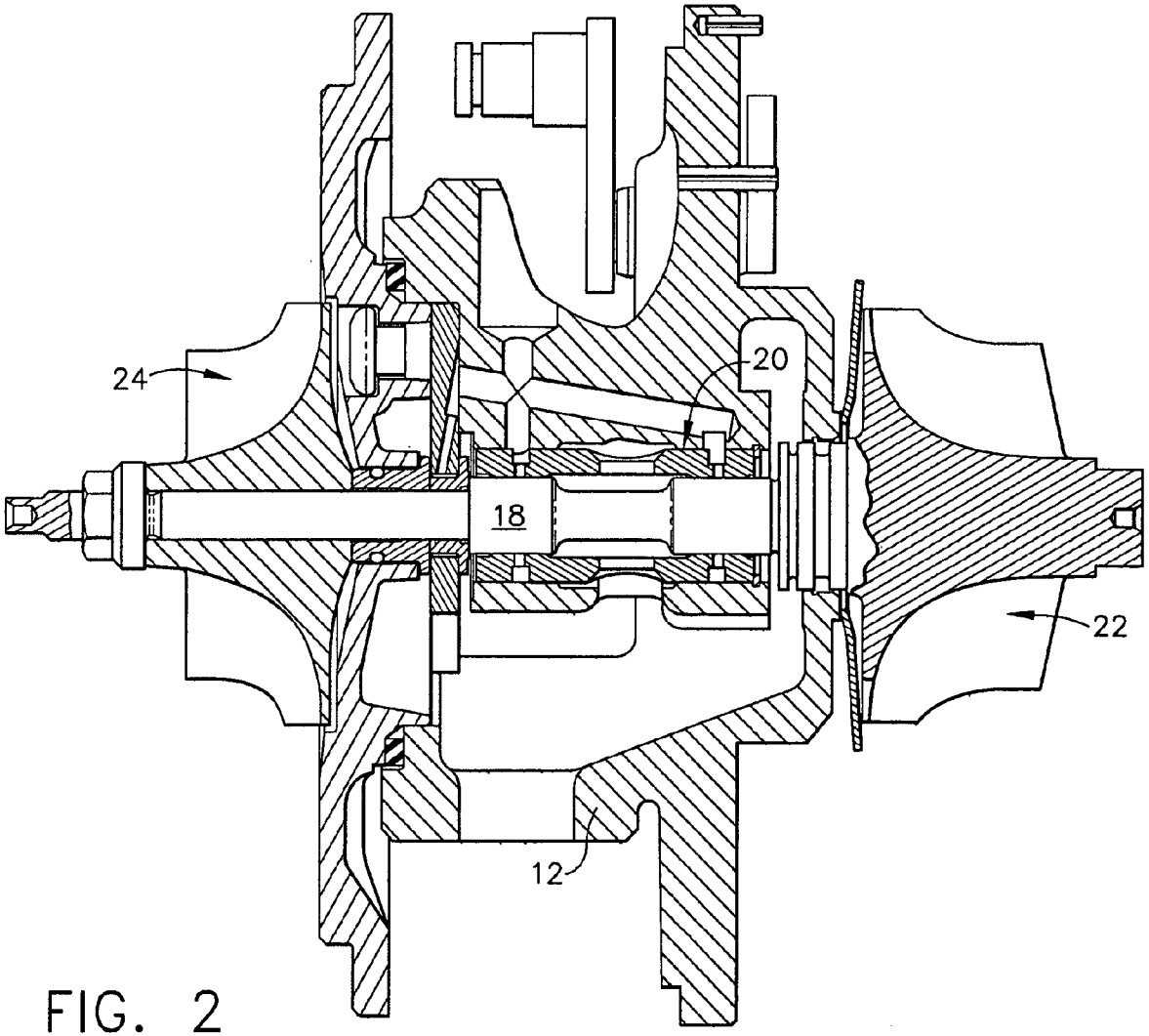
FIG. 2 is a cross-sectional side elevation of the variable geometry turbocharger of FIG. 1.

Referring to FIG. 1, a VGT 10 generally comprises a center housing 12 having a turbine housing 14 attached at one end, and a compressor housing 16 attached at an opposite end. Referring to FIG. 2, a shaft 18 is rotatably disposed within a bearing assembly 20 contained within the center housing 12. A turbine or turbine wheel 22 is attached to one shaft end and is disposed within the turbine housing, and a compressor impeller 24 is attached to an opposite shaft end and is disposed within the compressor housing. The turbine and compressor housings are attached to the center housing by, for example, bolts that extend between the adjacent housings.

Referring back to FIG. 1, the turbine housing is configured having an exhaust gas inlet 26 that is configured to direct exhaust gas radially to the turbine wheel, and an exhaust gas outlet 28 that is configured to direct exhaust gas axially away from the turbine wheel and the turbine housing. A volute (not shown) is connected to the exhaust inlet and an outer nozzle wall is incorporated in the turbine housing adjacent the volute. Exhaust gas, or other high energy gas supplying the turbocharger, enters the turbine housing through the inlet 26 and is distributed through the volute in the turbine housing for substantially radial delivery to the turbine wheel through a circumferential nozzle entry. The compressor housing 16 includes an air inlet 30, for directing air axially to the compressor impeller, and an air outlet (not shown), for directing pressurized air radially out of the compressor housing and to an engine intake system for subsequent combustion.

Figure 3A:
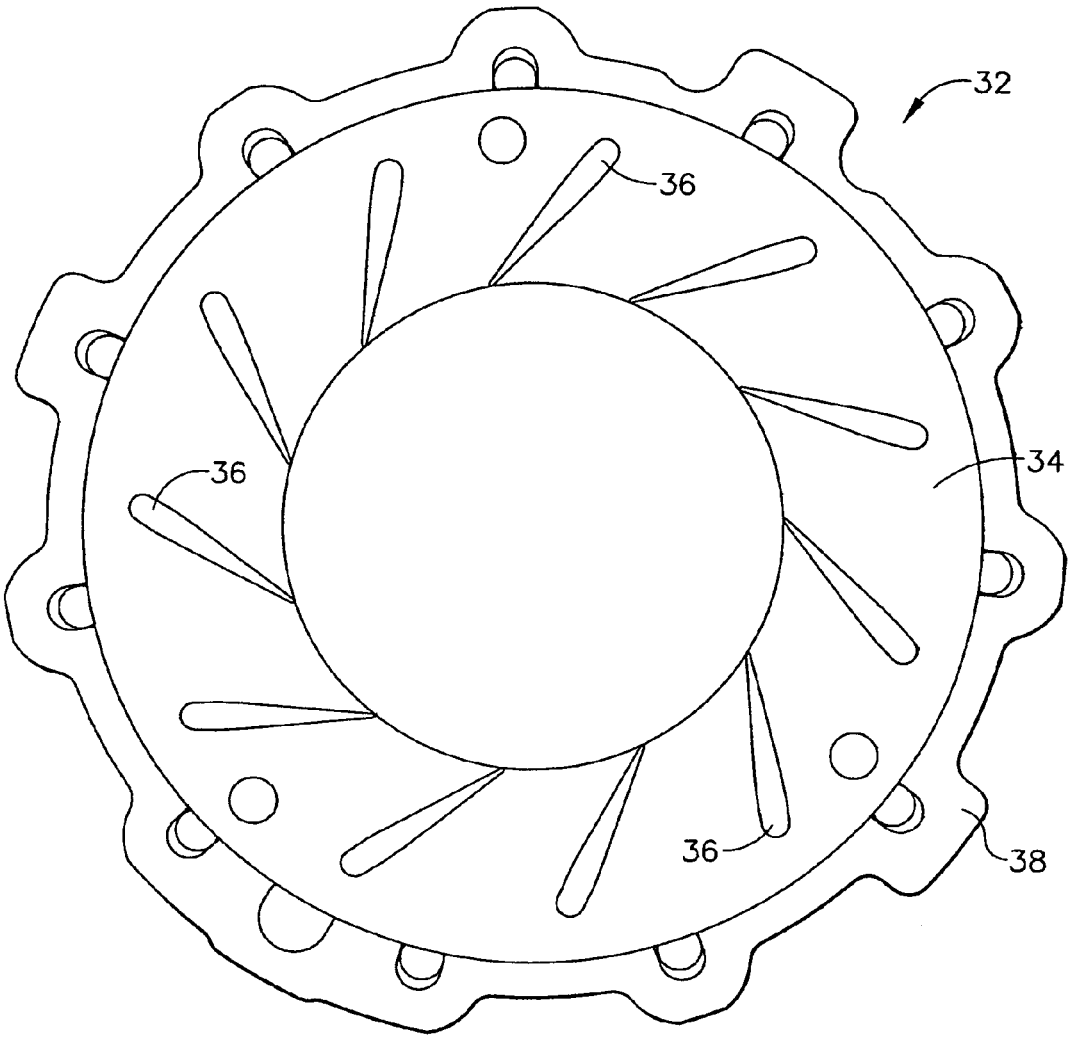
FIGS. 3A to 3C are top plan views of opposite surfaces of a nozzle ring that is disposed within a turbine housing of the variable geometry turbocharger of FIG. 1.

FIG. 3A illustrates a front side surface of a nozzle and unison ring assembly 32 that is disposed within the turbine housing, radially around the turbine wheel. Generally speaking, the nozzle and unison ring assembly operate to control the flow of exhaust gas entering the turbine housing to the turbine wheel, thereby regulating turbocharger operation. The assembly 32 comprises a nozzle ring 34 that is attached to, for example, a nozzle wall of the turbine housing and that is positioned concentrically around the turbine wheel. A number of movable, e.g., pivotable, vanes 36 are movably attached to the nozzle ring 34. The vanes 36 are positioned around the turbine wheel and operate to control exhaust gas flow to the turbine wheel. A unison ring 38 is movably coupled on an opposite surface of the nozzle ring to the multiple vanes 36 to effect vane movement in unison.

Figure 3B:
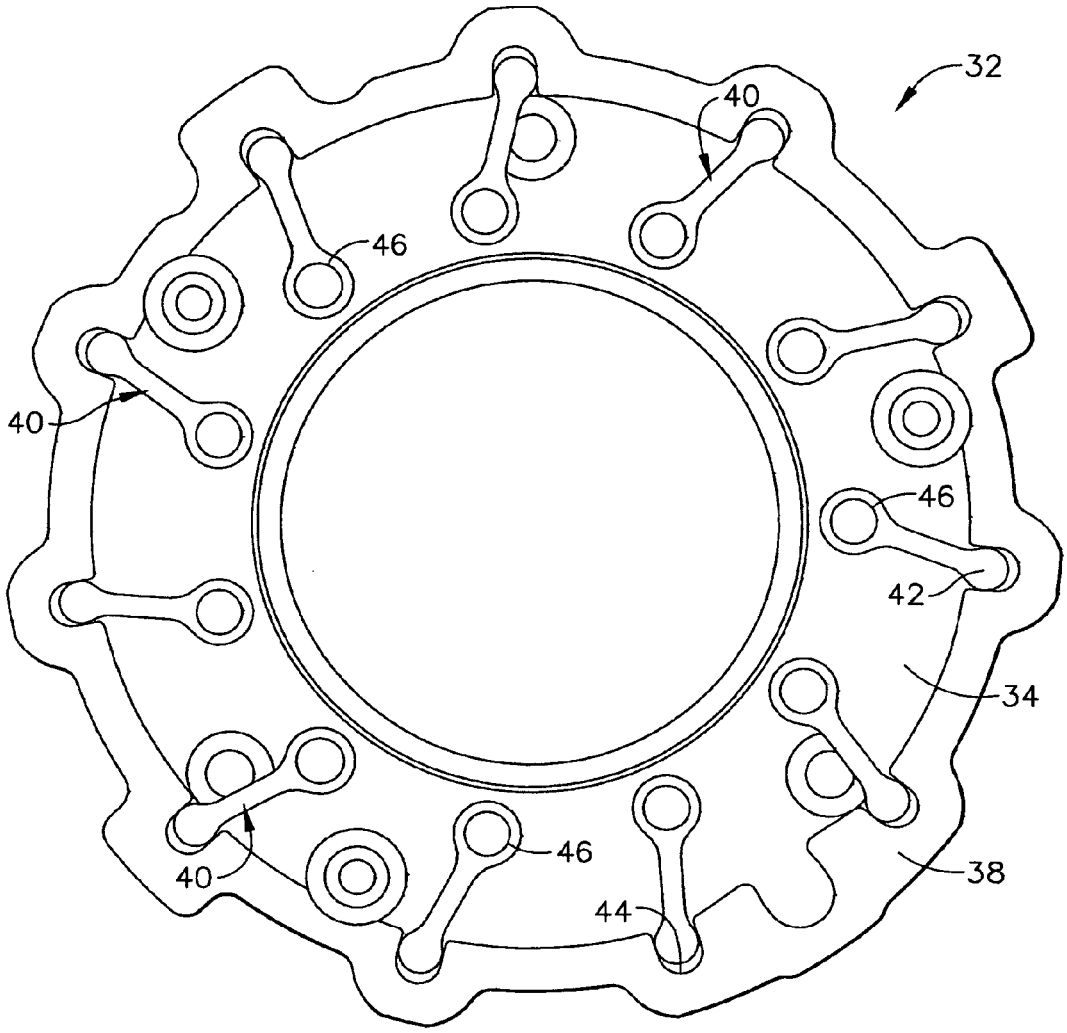
Figure 3C:
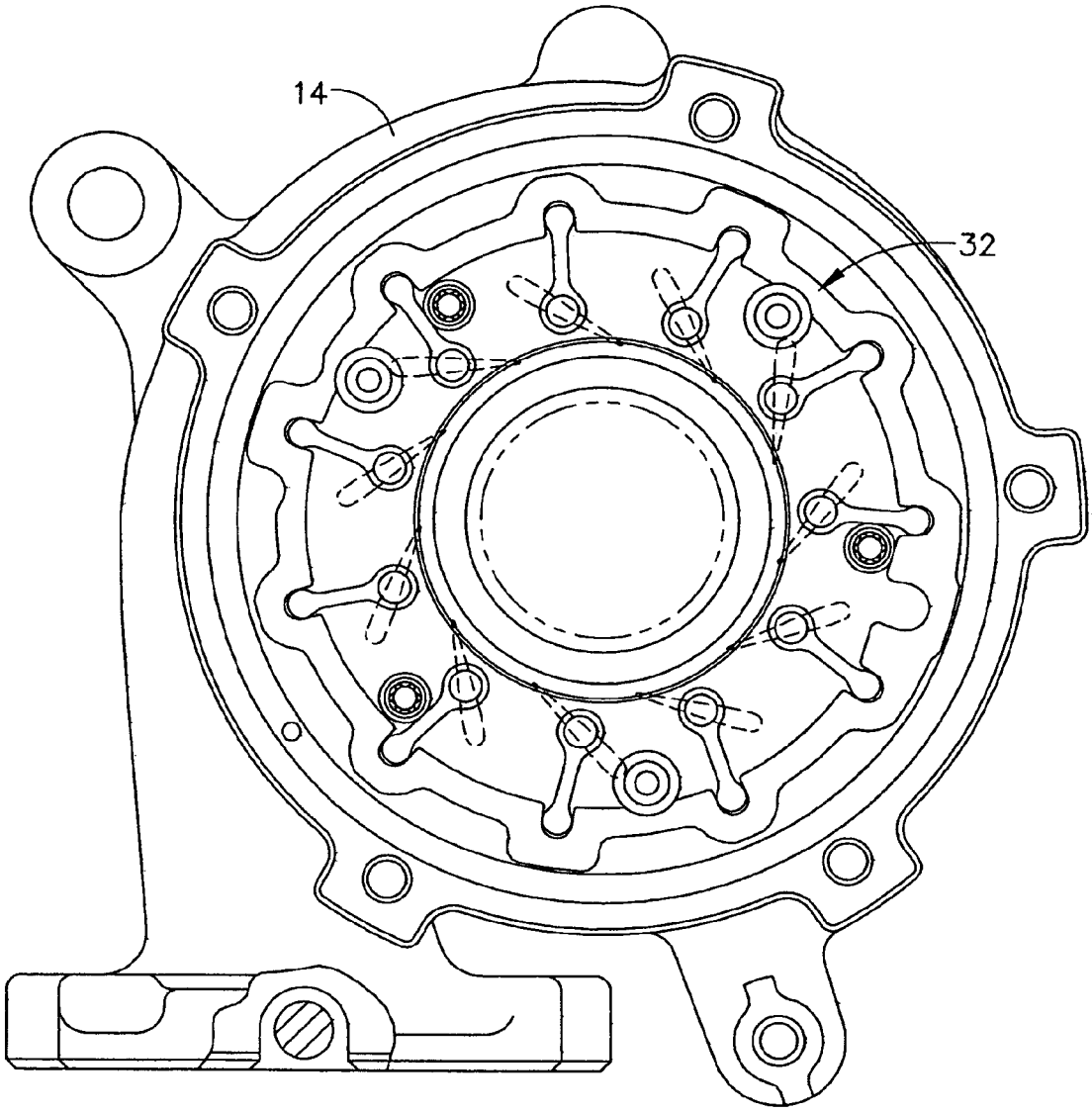

FIG. 3B illustrates an opposite surface of the nozzle and unison ring assembly 32, again showing the nozzle ring 34 and unison ring 38 that is disposed therearound. A number of arms 40 are interposed between/adjacent to the nozzle ring 34 and the unison ring 38 for the purpose of connecting the unison ring to the vanes. Each arm 40 includes an outer end 42 that is designed to movably fit within a respective complementary space or slot 44 disposed within the unison ring, and an inner end 46 that is designed to attach with a respective vane. FIG. 3C illustrates the same view of the nozzle and unison ring assembly 32 as FIG. 3B, this time as positioned within the VGT turbine housing 14.

Configured in this manner, the unison ring is to rotate within the turbine housing relative to the fixed nozzle ring, which rotation operates to move the arms 40 relative to the nozzle ring, thereby moving the vanes. An actuator assembly (not shown) is connected to the unison ring 38 and is configured to rotate the unison ring in one direction or the other as necessary to move the vanes radially outwardly or inwardly to control the pressure and/or volumetric flow of the exhaust gas that is directed to the turbine.

Figure 4B:
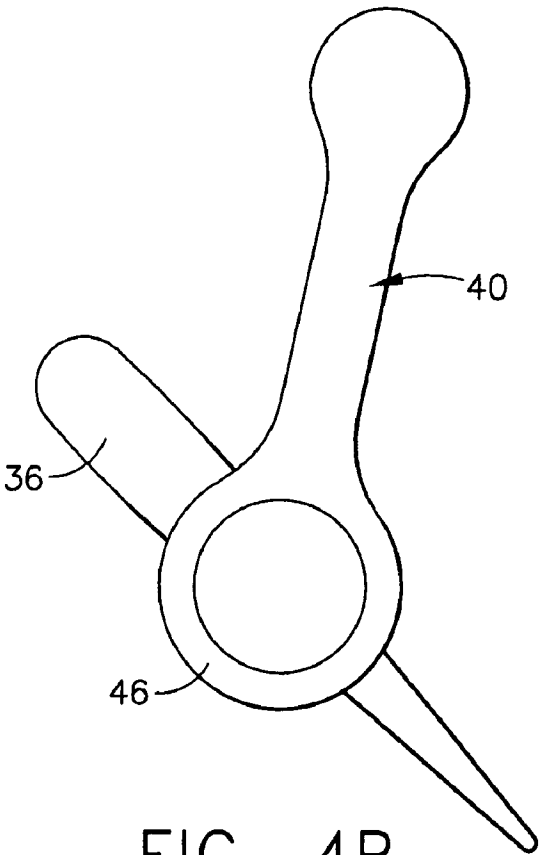
FIGS. 4A and 4B are respective side cross-sectional and top plan views illustrating placement of improved cambered vanes of this invention with the nozzle ring of FIGS. 3A and 3B.
Figure 4A:
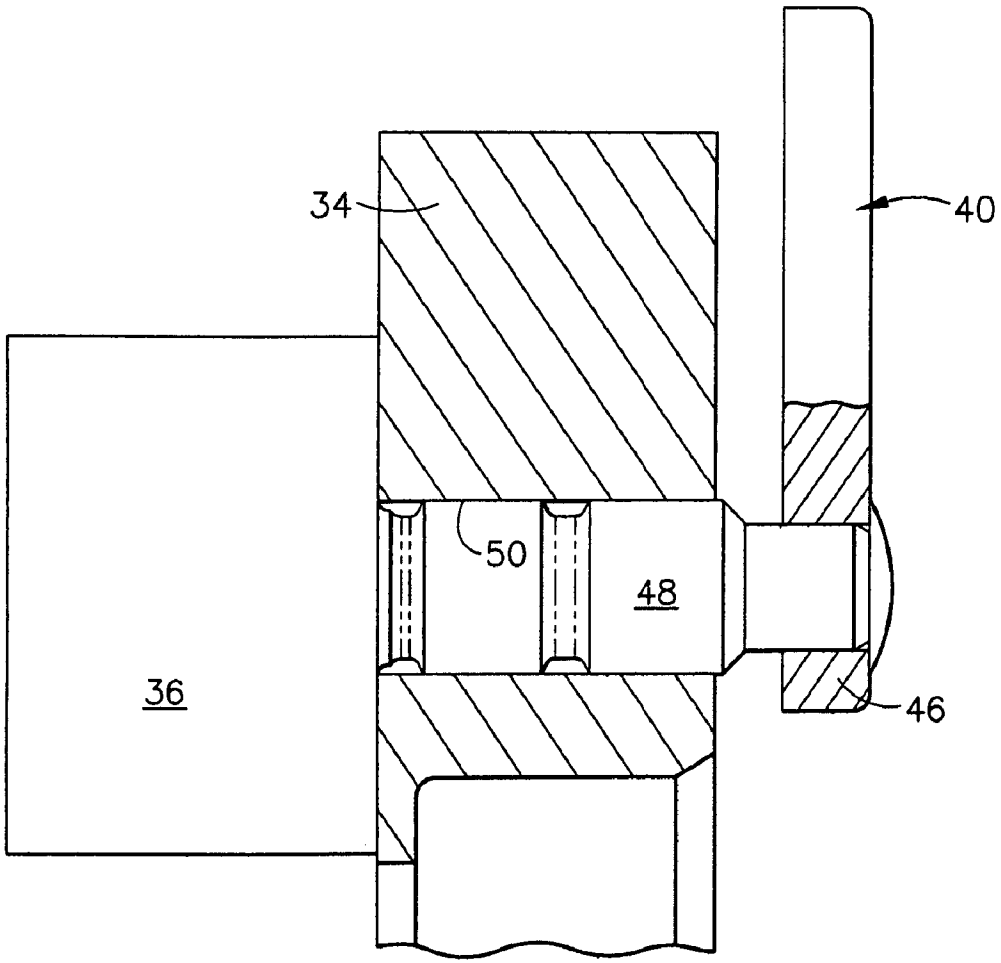

FIGS. 4A and 4B illustrate how the arms 40 and respective vanes 36 cooperate with one another through the nozzle ring 34. Each vane 36 is movably attached to the nozzle ring by, e.g., a pin 48 that is attached at one of its ends to an axial surface of the vane, and that is attached at an opposite end to end 46 of the arm 40. The pin projects through an opening 50 in the nozzle ring, and the vane and arm are fixedly attached to each respective pin end. Configured in this manner, rotational movement of each arm, on one surface of the nozzle ring, effects a pivoting movement of the vane, on the opposite surface of the nozzle ring.

Figure 5A:
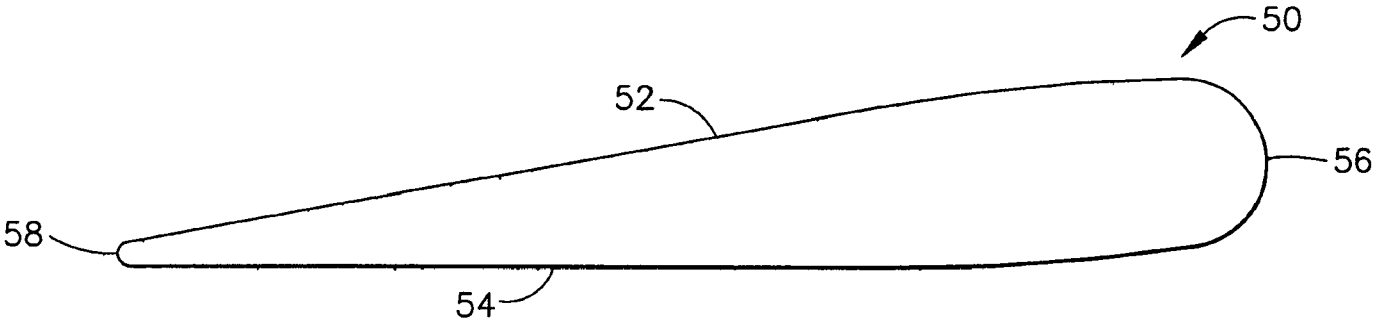
FIG. 5A (PRIOR ART)
FIGS. 5A and 5B are a respective elevational side view of a first prior art vane design as used with a variable geometry turbocharger, and a camberline graph for the same.

FIG. 5A illustrates a first conventional vane 50 known to be used with VGTs as described above. This particular vane is characterized by having an inner airfoil surface 52 and an outer airfoil surface 54 that are each flat or planar in design. Each inner and outer air foil surface extends from a vane leading edge or nose 56 having a first radius of curvature, to a vane trailing edge or tail 58 having a substantially smaller radius of curvature. This conventional vane design is characterized by having a symmetric shape relative to an axis running through the vane from the leading to the trailing edges. That is, the inner airfoil surface 52 and outer airfoil surface 54 are symmetric relative to one another, resulting in a flat camberline.

Figure 5B:
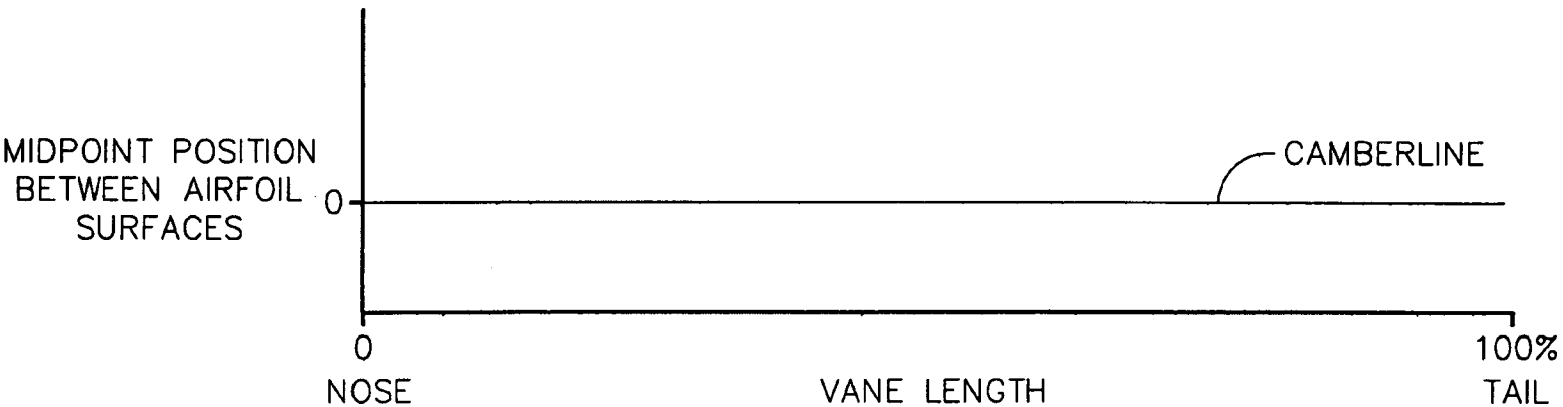
FIG. 5B (PRIOR ART)

The symmetric shape of this first conventional vane design is reflected in FIG. 5B that illustrates the camberline graph for the vane. The camberline of a vane, also commonly referred to as the centerline, is the line that runs through the midpoints between the vane inner and outer airfoil surfaces between the leading and trailing vane edges. Its meaning is well understood by those skilled in the relevant technical field. The mathematical description of the camberline is a relatively complex series of functions, however these functions are also commonly understood by those skilled in the relevant technical field. In practice, the camberline can be represented by a plot of the midpoints between the vane inner and outer airfoil surfaces at set intervals running along the length of the vane defined between the leading and trailing vane edges. The camberline can also be represented by a plot of the centers of multiple circles drawn inside the vane tangent to both the inner and outer airfoil surfaces.

As used herein, the vane length is an inherent feature of the vane and is defined as the length of the straight line that runs between the leading and trailing vane edges. For the plots contained in FIGS. 5B, 6B, 7B, 8B and 9B, the x-axis represents distance along the vane measured as a percentage of the vane length. The y-axis represents distance from an arbitrary reference line parallel to the x-axis; for sake of convenience herein, the vane leading edge and trailing edge each have a y-coordinate set at zero and the x-axis therefore runs through these two points. In the case of FIG. 5B, the camberline graph for this vane design is essentially flat, showing no changes in curvature in the vane. Thus, this first conventional vane can be referred to as a "straight" vane.

The use of such straight vane in VGTs has been shown to provide unwanted aerodynamic effects within the turbine housing. Specifically, this vane design produces an unwanted back-pressure within the turbine housing thought to be caused by a reduced rate of acceleration as the exhaust gas is passed over the vane nose and along the remaining vane surface. The leading edge profile of this vane design does not contribute to optimal aerodynamic efficiency. Also, the straight design of the inner and outer airfoil surfaces do not operate to provide a smooth aerodynamic surface when the vanes are staged together in a closed position, e.g., the transition of air as it flows over the tail of one vane and to the nose of an adjacent vane is not as aerodynamic as desirable.

Figure 6A:
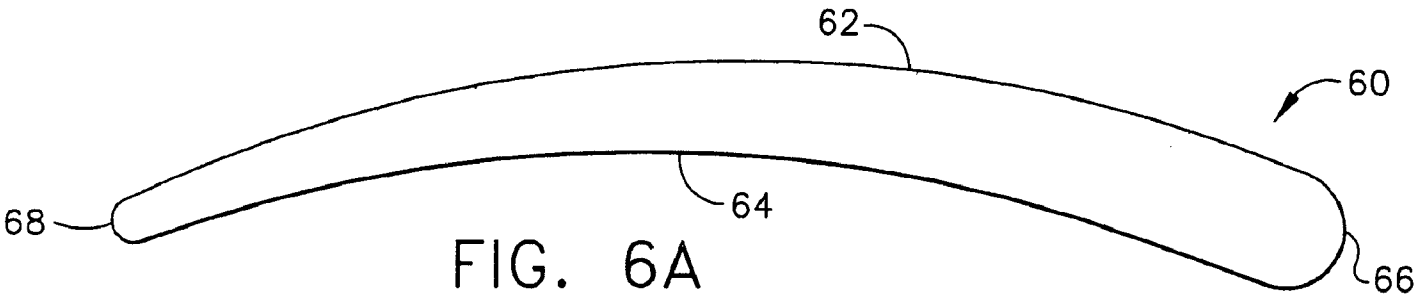
FIG. 6A (PRIOR ART)
FIGS. 6A and 6B are a respective elevational side view of a second prior art vane design as used with a variable geometry turbocharger, and a camberline graph for the same.

FIG. 6A illustrates a second conventional vane 60 known to be used with VGTs as described above. This particular vane is characterized by having an inner airfoil surface 62 and an outer airfoil surface 64 that are each curved in design. Each inner and outer air foil surface extends from a vane leading edge or nose 66 having a first radius of curvature, to a vane trailing edge or tail 68 having a substantially smaller radius of curvature. In this vane design, the outer airfoil surface 62 is convex in shape and is defined by a substantially continuous curve, while the inner airfoil surface 64 is concave in shape and is defined by a substantially continuous curve that complements the outer airfoil surface. As used herein, the vane surfaces are characterized as "concave" or "convex" relative to the interior (not the exterior) of the vane. Unlike the straight conventional vane described above, this vane is characterized by having an asymmetric shape relative to an axis running through the vane from the leading to the trailing edges.

Figure 6B:
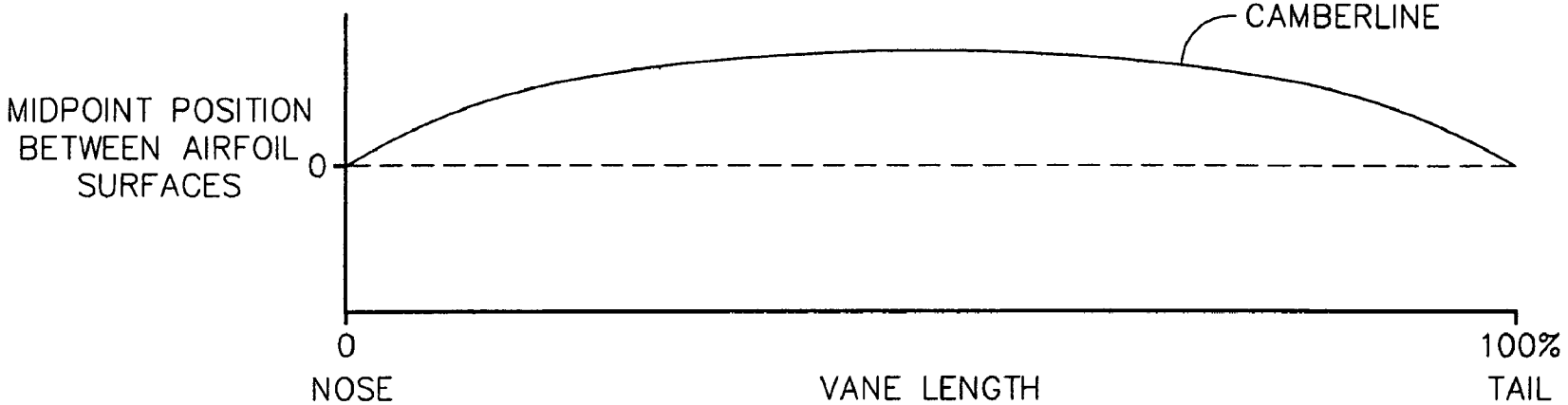
FIG. 6B (PRIOR ART)

The asymmetric shape of this second conventional vane design is reflected in FIG. 6B that illustrates a camberline graph for the vane. The camberline graph for this particular vane design is essentially a continuous curve that starts at the nose and that extends to the tail. Because this vane has a curved camberline, it as a "cambered" vane.

The use of such conventional cambered vane in VGTs has resulted in some improvement in aerodynamic effects within the turbine housing over the straight vane design.

Specifically, the design of this conventional cambered vane operates to reduce unwanted aerodynamic effects in the turbine housing by creating a relatively more even acceleration of the gas around the downstream portion of the vane (i.e., the portion that is about 25 to 100 percent of the vane length where 0 percent represents the leading edge or nose positioned along a first inner and outer airfoil surface junction). In other words, with this type of vane there is less over-acceleration that in turn would require subsequent deceleration.

Figure 7A:
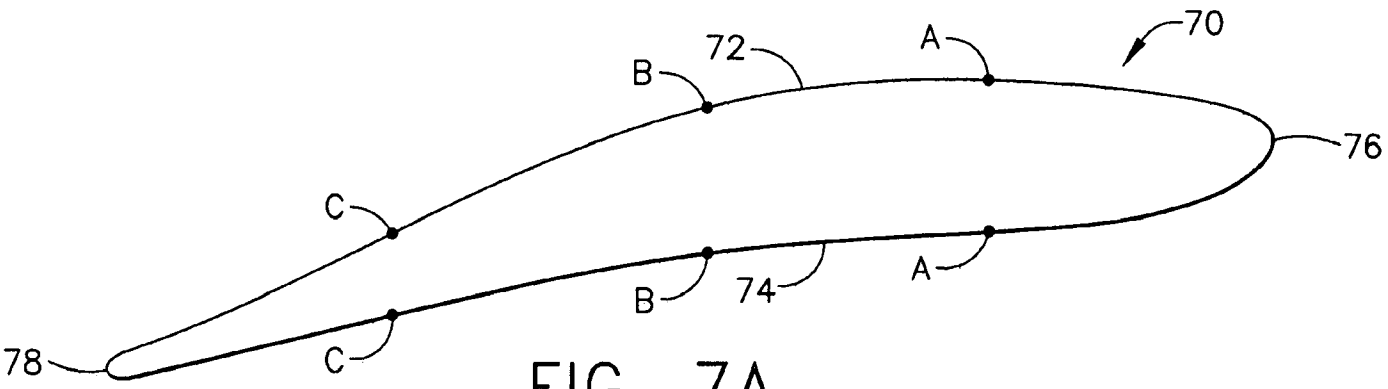
FIGS. 7A and 7B are a respective elevational side view of a first embodiment improved cambered vane of this invention, and a camberline graph for the same.

FIG. 7A illustrates a first embodiment improved cambered vane 70 of this invention comprising an outer airfoil surface 72 that is generally but not necessarily convex in shape and that is defined by a composite series of curves, and an opposite inner airfoil surface 74 that includes convex and concave-shaped sections and that is also defined by a composite series of curves. A leading edge 76 or nose is disposed at one end of the vane between the inner and outer airfoil surfaces, and a trailing edge 78 or tail is disposed at an opposite end of the vane between the inner and outer airfoil surfaces.

Figure 7B:
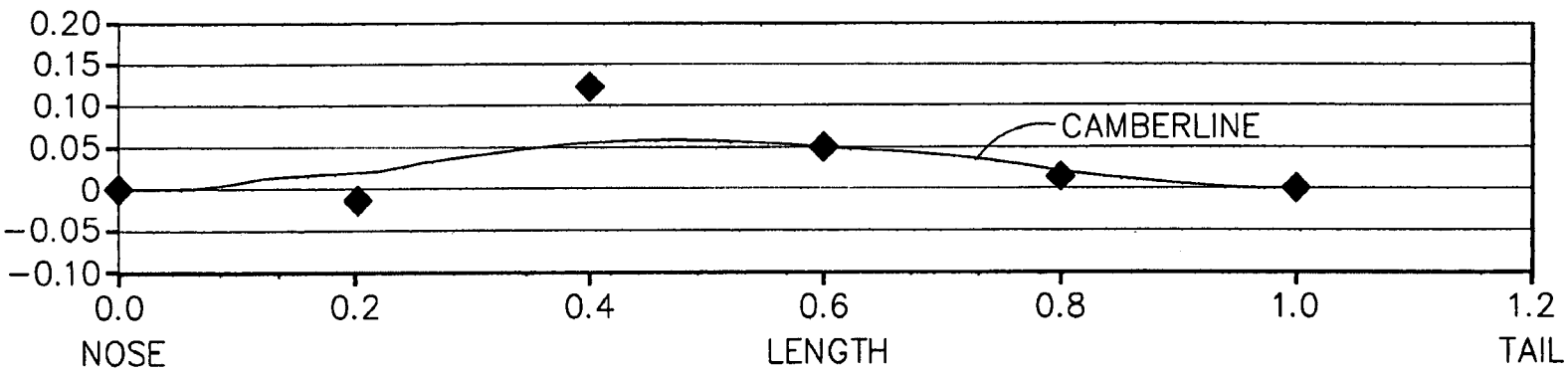

A key feature of improved cambered vanes of this invention is that although the vane is cambered, a front end portion of the vane, i.e., the portion of the vane extending a distance from the vane leading edge 76, is characterized by having a substantially flat camberline. Referring to FIG. 7B, the flatness or non-curvature of the camberline moving from the vane leading edge a distance along the vane is clearly illustrated. The desired flatness of camberline for improved cambered vanes of this invention is achieved by providing outer and inner airfoil surfaces that are designed to complement each other to provide an overall flat camberline for an initial vane length.

It is desired that the improved cambered vanes be characterized by a camberline that is substantially flat moving from the vane leading edge a distance that is in the range of from about 5 to 40 percent of the vane length. In this particular embodiment, the vane is configured such that the camberline is essentially flat for the first 10 percent of the vane length, at which point the camberline becomes curved.

A vane having a camberline that is flat for less than about 5 percent of the vane length measured from the leading edge results in less than optimal performance because the flow near the leading edge or nose accelerates relatively too rapidly. A vane having a camberline that is flat for greater than about 40 percent of the vane length also results in less than optimal performance because the gas flow tends to over-accelerate near the middle of the vane, requiring subsequent undesired deceleration.

The first embodiment improved cambered vane includes a leading edge 76 that is defined by a radius of curvature that is less than the maximum vane thickness. As used herein, vane thickness is an inherent feature of the vane and is defined as the distance or width that exists between the vane outer and inner airfoil surfaces measured perpendicular (normal) to the camberline. Maximum vane thickness, which is also an inherent feature of the vane, is therefore the greatest distance or width that exists between the vane outer and inner airfoil surfaces measured in the same fashion. Improved cambered vanes of this invention preferably have a leading edge defined by a radius of curvature that is in the range of from about 10 to 30 percent of the maximum vane thickness. This reduced leading edge radius is desired as it helps to reduce unwanted aerodynamic effects as exhaust gas encounters the vane.

Additionally, improved cambered vanes have a maximum thickness that is not greater than about 25 percent of the vane length. Preferred embodiments of vanes of this invention have a maximum thickness that is in the range of from about 10 to 25 percent of the vane length. In an example first vane embodiment, wherein the vane length is approximately 17.5 mm, the maximum vane thickness is approximately 12.7 percent of the vane length, or approximately 2.2 mm. It is desired that cambered vanes have a vane thickness that is within this range because a vane thickness of less than about 10 percent of the vane length makes it difficult for the flow to follow the vane surface, resulting in flow that separates from the vane surface thus increasing undesired back-pressure. On the other hand, a vane thickness of more than about 25 percent of the vane length results in excessive gas flow acceleration around the vane surface, requiring undesired deceleration prior to the vane trailing edge.

Moving along the vane 70 from the leading edge 76, the upper airfoil surface 72 is initially almost flat along section A, transitions to a slightly downwardly directed convex-shaped curve along section B, and further transitions to a slightly concave-shaped curve at section C as it extends to the trailing edge 78. The trailing edge 78 has a radius of curvature that is less than that of the leading edge. The inner airfoil surface 74, is initially curved in a convex manner at section A moving from the leading edge. At section B the inner airfoil surface transitions to a slightly concave-shaped curve, and at section C the inner airfoil surface is almost flat moving to the trailing edge 78.

The combined shapes of the outer and inner airfoil surfaces of all improved cambered vanes of this invention operate both to direct exhaust gas flow over the vane surfaces in a manner desired to direct the exhaust gas towards the turbine wheel, and to contribute to the overall desired camberline of the vane that promotes improved aerodynamic efficiency. Generally speaking, it is desired that the inner and outer airfoil surfaces of all improved cambered vanes of this invention be configured in a manner that provides a vane camberline characterized by a gradual curve that starts at a point between about 5 to 40 percent of the initial vane length, that gradually increases to a maximum point at between about 40 to 80 percent of the initial vane length, and that gradually decreases back to zero at or before the end of the vane length.

Vanes of this invention that are characterized by such vane camberlines operate to minimize unwanted aerodynamic effects within the turbine housing. Specifically, vanes of this invention operate to provide a constant rate of exhaust gas acceleration as the exhaust gas is passed over the nose of the vane and along the remaining vane surface. This constant rate of acceleration is important to minimizing unwanted back-pressure effects in the turbine housing which are known to contribute to losses in turbocharger and turbocharged engine operating efficiencies.

Figure 8A:
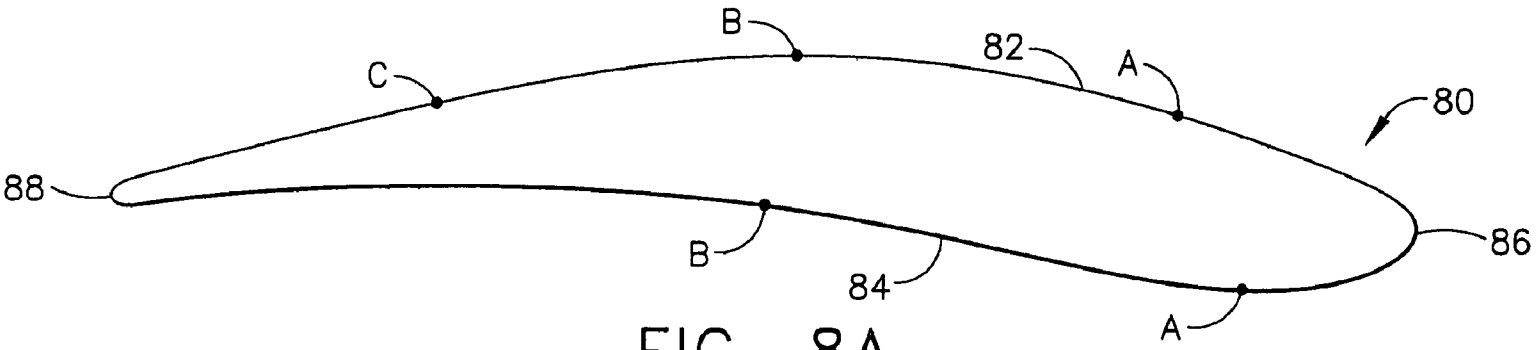
FIGS. 8A and 8B are a respective elevational side view of a second embodiment improved cambered vane of this invention, and a camberline graph for the same.

FIG. 8A illustrates a second embodiment improved cambered vane 80 of this invention comprising an outer airfoil surface 82 that is generally convex in shape and that is defined by a composite series of curves, and an opposite inner airfoil surface 84 that includes convex and concave-shaped sections and that is also defined by a composite series of curves. A leading edge 86 or nose is disposed at one end of the vane between the inner and outer airfoil surfaces, and a trailing edge 88 or tail is disposed at an opposite end of the vane between the inner and outer airfoil surfaces.

Figure 8B:
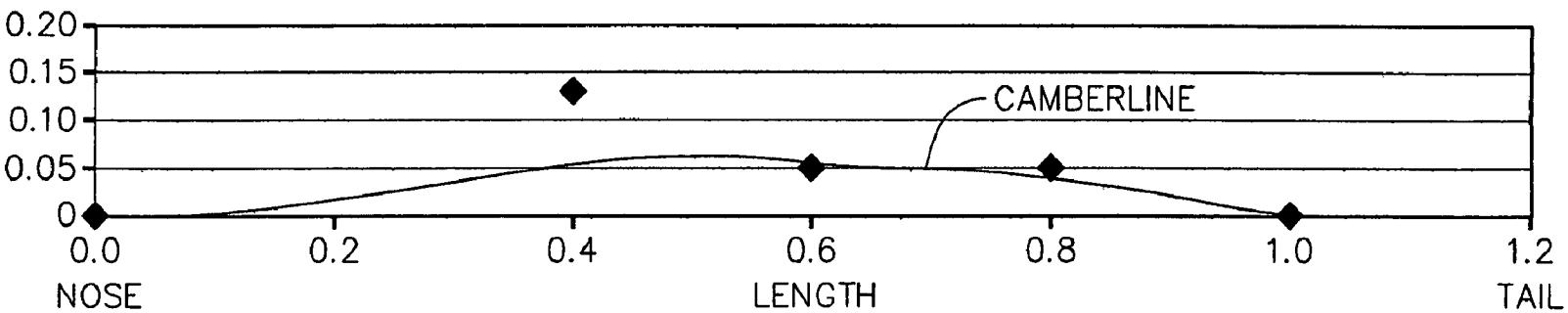

Like the first embodiment improved cambered vane described above, this second embodiment cambered vane also includes a front end portion, i.e., the portion of the vane extending a distance from the vane leading edge 86, that is characterized by having a substantially flat camberline. Referring to FIG. 8B, the flatness or non-curvature of the camberline moving from the vane leading edge a distance along the vane is clearly illustrated. In this particular embodiment, the vane 80 is configured such that the camberline is essentially flat for the first 12 percent of the vane length, at which point the camberline becomes curved.

The second embodiment improved cambered vane includes a leading edge 86 that is defined by a radius of curvature that is less than the maximum vane thickness. In an example second vane embodiment, wherein the vane length is approximately 20 mm, the maximum vane thickness is approximately 13 percent of the vane length, or approximately 2.6 mm.

Moving along the vane 80 from the leading edge 86, the upper airfoil surface 82 is initially almost flat along section A, transitions to a slightly downwardly directed convex-shaped curve along section B, and further transitions to a slightly convex-shaped curve at section C as it extends to the trailing edge 88. The trailing edge 88 has a radius of curvature that is less than that of the leading edge. The inner airfoil surface 84, is initially curved in a convex manner at section A moving from the leading edge. Section A of this second vane embodiment is defined by a slightly more exaggerated curve when compared to the same section A of the first embodiment vane of FIG. 7A. At section B the inner airfoil surface transitions to a slightly concave-shaped curve as it extends to the trailing edge 88.

The combined shapes of the inner and outer airfoil surface of this second vane embodiment operate to provide a camberline that is slightly different from that of the first vane embodiment; specifically, for the last 40 percent or so of the vane length. The second embodiment vane is configured having outer and inner airfoil surfaces that both curve generally downwardly, i.e., radially inwardly toward a centrally positioned turbine wheel, as they approach the trailing edge 88. This different geometry results in a camberline profile along the terminal vane length (trailing edge) that does not taper to zero as with the first vane embodiment shown in FIG. 7A, rather for this second vane embodiment shown in FIG. 8A the camberline at the trailing edge approaches zero as a curve intersecting the length axis, i.e., in a non-tapered manner.

The second embodiment improved cambered vane is designed having an airfoil profile that is slightly different from that of the first embodiment as noted above. In this second embodiment the vane length is greater and therefore the relative location between two adjacent vanes in a turbocharger will be different. The vane shape in this second embodiment goes hand-in-hand with the longer vane length in order to provide the same even flow acceleration that is obtained with the shorter vane and alternative vane profile of the first embodiment.

Figure 9A:
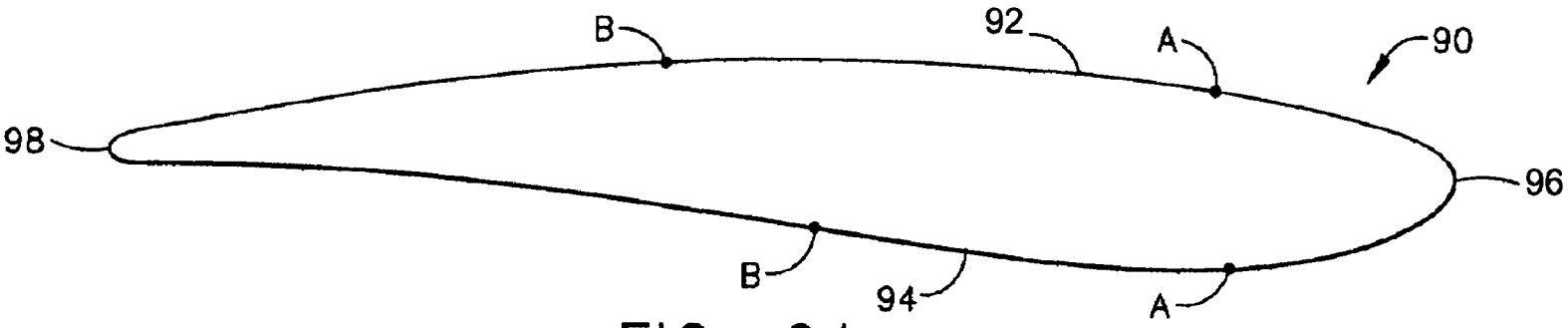
FIGS. 9A and 9B are a respective elevational side view of a third embodiment improved cambered vane of this invention, and a camberline graph for the same.

FIG. 9A illustrates a third embodiment improved cambered vane 90 of this invention comprising an outer airfoil surface 92 that is generally convex in shape and that is defined by a composite series of curves, and an opposite inner airfoil surface 94 that includes convex and concave-shaped sections and that is also defined by a composite series of curves. A leading edge 96 or nose is disposed at one end of the vane between the inner and outer airfoil surfaces, and a trailing edge 98 or tail is disposed at an opposite end of the vane between the inner and outer airfoil surfaces.

Figure 9B:
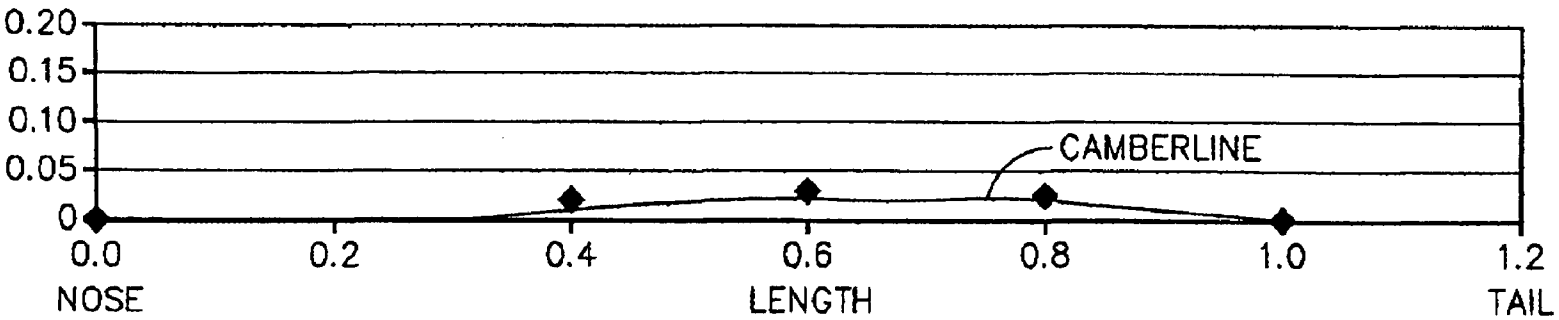

Like the first and second embodiment improved cambered vanes described above, this third embodiment cambered vane also includes a front end portion, i.e., the portion of the vane extending a distance from the vane leading edge 96, that is characterized by having a substantially flat camberline. Referring to FIG. 9B, the flatness or non-curvature of the camberline moving from the vane leading edge a distance along the vane is clearly illustrated. In this particular embodiment, the vane 90 is configured such that the camberline is essentially flat for the first 30 percent of the vane length, at which point the camberline becomes curved.

The third embodiment improved cambered vane includes a leading edge 96 that is defined by a radius of curvature that is less than the maximum vane thickness. In an example third vane embodiment, wherein the vane length is approximately 18 mm, the maximum vane thickness is approximately 13.5 percent of the vane length, or approximately 2.4 mm.

Moving along the vane 90 from the leading edge 96, the upper airfoil surface 92 is initially almost flat along section A, transitions to a slightly convex-shaped curve along section B as it extends to the trailing edge 98. The trailing edge 98 has a radius of curvature that is less than that of the leading edge. The inner airfoil surface 94 is initially curved in a convex manner at section A moving from the leading edge. Section A of this third vane embodiment is defined by a slightly more gradual curve when compared to the same section A of the second embodiment vane of FIG. 8A. At section B the inner airfoil surface transitions to a slightly concave-shaped curve as it extends to the trailing edge 98.

The combined shapes of the inner and outer airfoil surface of this third vane embodiment operate to provide a camberline that is slightly different from that of both the first and second improved cambered vane embodiments of this invention. Specifically, the third vane embodiment is defined by outer and inner airfoil surfaces that are more gradually curved than that of the other two vane embodiments, thereby producing a camberline that is characterized by a very gradual curve of reduced amplitude.

The third embodiment improved cambered vane is designed having an airfoil profile that is slightly different from that of the first and second vane embodiments, as noted above. This third embodiment vane is designed to be used in a turbocharger containing a different total number of vanes which are located closer radially to the turbine wheel, and the somewhat different vane shape of this embodiment is preferred in order to provide the same even flow acceleration that is obtained with the alternative vane profiles of the first and second embodiments.

As noted above, cambered vanes of this invention are characterized by outer and inner airfoil surfaces having gradually rather than abruptly changing surface features. The surface features of the opposed airfoil surfaces operate to define the vane width as a function of the length position along the vane. Vanes of this invention have a width or cross-sectional thickness that varies according to length position in the following manner.

Moving along the length of the vane from the nose to the tail, vanes of this invention have a width that changes gradually rather than abruptly. For example, vanes of this invention include a width that increases in a gradual manner moving inwardly a distance from a tip of the nose to a location about one-quarter of the vane length. In an example embodiment, the width along this first quarter segment of the vane length can increase up a maximum width of the vane as described above.

Moving inwardly from the quarter location point in the vane to a mid point of the vane length, the vane width remains relatively constant. Along this second quarter segment of the vane length the width can increase or decrease, but any such change along this segment is minimal and is limited to not more than plus or minus about five percent of the vane width as measured at the mid point.

Moving from the mid point to a point located about three-quarters of the length of the vane, the vane width decreases in a gradual manner. In an example embodiment, the vane width along this third quarter segment of the vane length decreases to a width that is no less than about 40 percent of the vane width as measured at the mid point, and in a preferred embodiment can be in the range of from about 50 to 65 percent of the vane width as measured at the mid point.

Moving from the three-quarters point to the tail, the vane width continues to decrease in a gradual manner. In an example embodiment, the vane width along this forth quarter segment of the vane length decreases to no less than about 10 percent of the vane width as measured at the three-quarters point, and in a preferred embodiment can be in the range of from about 25 to 40 percent of the vane width as measured at the mid point.

Figure 10:
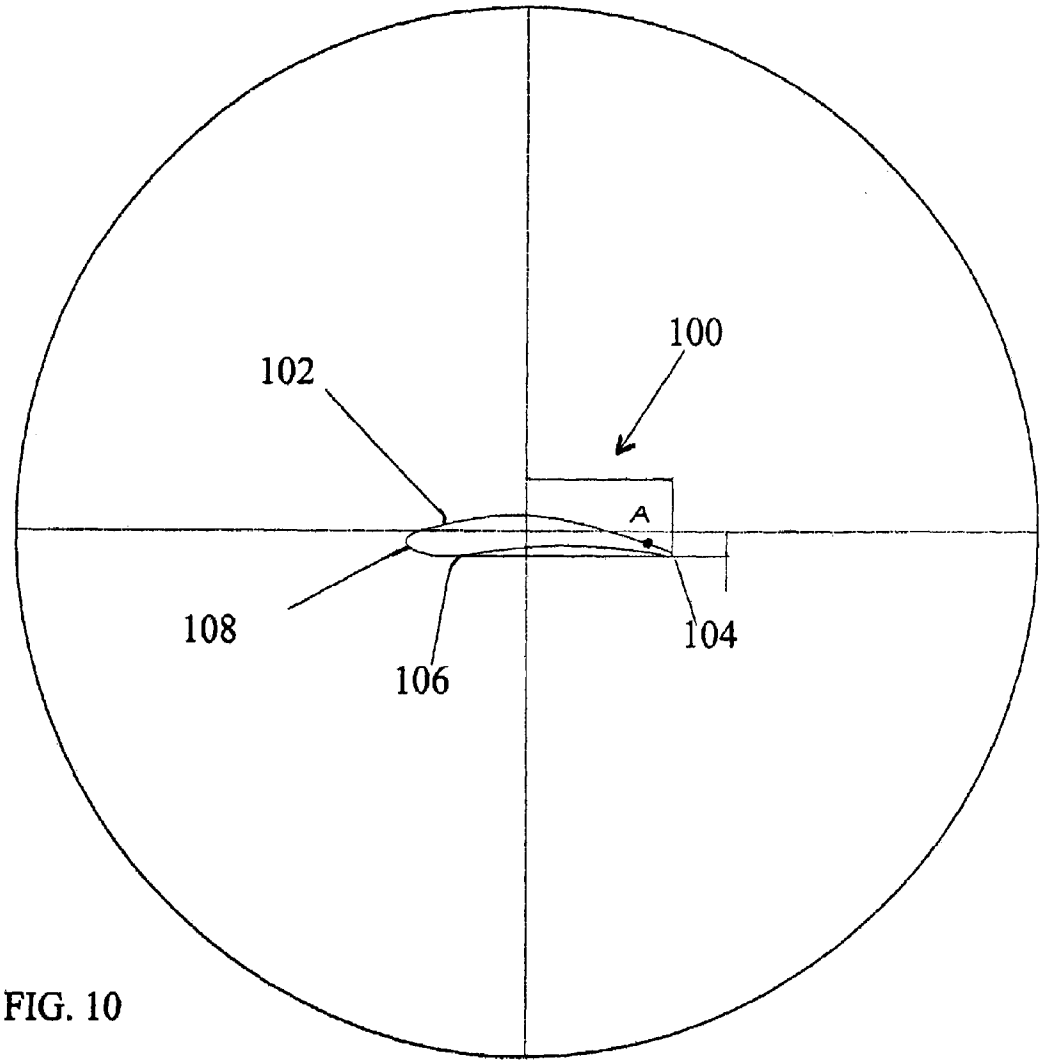
FIG. 10 is an elevational side view of the improved cambered vane as illustrated in FIG. 8A.

FIG. 10 illustrates a cambered vane 100 of this invention that is the same as the second vane embodiment discussed above and illustrated in FIG. 8A. FIG. 10 presents the vane in the setting of an x- and y-axis coordinate system for purposes of better referencing and appreciating the specific geometry of the vane surfaces. Specifically for referencing and appreciating the specific shapes of the vane airfoil surfaces and the gradual manner in which the outer and inner airfoil surfaces change to provide the desired vane performance characteristics.

FIG. 11 presents x and y coordinate values for the vane profile provided in FIG. 10 at different points on the vane outer and inner airfoil surfaces moving sequentially around the vane profile. For example, the first set of x and y coordinate data represents a location in the $3^{rd}$ quadrant of the coordinate system on the vane outer airfoil surface 102 at approximately point A (shown in FIG. 10). The remaining sets of x and y coordinate data represent points on the vane profile that, moving from point A, extend down and around the trailing edge 104, along the inner airfoil surface 106, around the vane leading edge 108, and back along the outer airfoil surface 102.

Improved cambered vanes of this invention are specifically designed for the purpose of providing improved aerodynamic efficiency associated with the passage of exhaust gas within the turbine housing. The vane outer and inner airfoil surfaces, in conjunction with the vane leading and trailing edges, are configured to provide a camberline that is flat a distance along the vane length beyond the vane leading edge. Additionally, the outer and inner airfoil surfaces are designed to complement each other when the vanes are mounted on the nozzle ring adjacent one another. The inner and outer airfoil surfaces of adjacent vanes provide opposed converging airfoil surfaces that help to reduce back-pressure within the turbine housing when compared to the conventionally configured vanes.

Improved cambered vanes of this invention can be formed from the same types of materials, and in the same manner, e.g., molded, folded or machined, as that used to form conventional prior art vanes. The vanes can have a substantially solid design or can be configured having a hollow or cored out design, depending on the particular application. In an example embodiment, the improved vanes of this invention are configured having solid axial surfaces.

Having now described the invention in detail as required by the patent statutes, those skilled in the art will recognize modifications and substitutions to the specific embodiments disclosed herein. Such modifications are within the scope and intent of the present invention.

What is claimed is:

1. A turbocharger assembly comprising:

a turbine housing having an exhaust gas inlet and an exhaust outlet, and a volute connected to the inlet;

a turbine wheel carried within the turbine housing and attached to a shaft;

a plurality of vanes disposed within the turbine housing between the exhaust gas inlet and turbine wheel, each vane comprising:

an inner airfoil surface;

an outer airfoil surface oriented opposite the inner airfoil surface, the inner and outer airfoil surfaces defining a vane thickness;

a leading edge positioned along a first inner and outer airfoil surface junction;

a trailing edge positioned along a second inner and outer airfoil surface junction, the leading and trailing edges defining a vane length;

wherein the inner airfoil and outer airfoil surfaces define a camberline positioned therebetween and extending from the leading edge to the trailing edge, wherein the camberline includes a curved section and is substantially flat along at least about the first five percent of the vane length moving from the leading edge, wherein the vane thickness at a location on the vane a distance from the leading edge of approximately three quarters the vane length is greater than about 40 percent of the vane thickness at a location on the vane a distance from the leading edge of approximately one-half the vane length; and wherein the leading edge is defined by a radius of curvature that is in the range of about 10 to 30 percent of the maximum vane thickness.

2. The turbocharger assembly as recited in claim 1 wherein the vane camberline is substantially flat along about the first 5 to 40 percent of the vane length moving from the leading edge.

3. The turbocharger assembly as recited in claim 1 wherein the maximum vane thickness is in the range of about 10 to 25 percent of the vane length.

4. The turbocharger assembly as recited in claim 1 wherein the vane has a gradually decreasing thickness moving from a location on the vane a distance from the leading edge of approximately three quarters the vane length to the vane trailing edge.

5. The turbocharger assembly as recited in claim 1 wherein the vanes further include:

an axial surface disposed between the inner and outer airfoil surfaces;

a pin projecting outwardly from the axial surface; and an arm attached to an end of the pin opposite the vane and comprising a single outer end.

6. The turbocharger assembly as recited in claim 5 further comprising first and second rings disposed within the turbocharger, the first ring being attached to a portion of the turbocharger and having a plurality of openings, wherein the vanes are rotatably mounted on the first ring by engagement of the pins within the openings, the second ring being disposed within the turbocharger and positioned adjacent the first ring, the second ring being rotationally movable relative to the first ring and including a plurality of slots, each vane arm outer end being disposed within a respective slot.

7. A turbocharger assembly comprising:

a turbine housing having an exhaust gas inlet and an exhaust outlet, and a volute connected to the inlet;

a turbine wheel carried within the turbine housing and attached to a shaft;

a plurality of vanes disposed within the turbine housing between the exhaust gas inlet and turbine wheel, each vane comprising:

an inner airfoil surface;

an outer airfoil surface oriented opposite the inner airfoil surface, the inner and outer airfoil surfaces defining a vane thickness;

a leading edge positioned along a first inner and outer airfoil surface junction;

a trailing edge positioned along a second inner and outer airfoil surface junction, the leading and trailing edges defining a vane length;

an axial surface disposed between the inner and outer airfoil surfaces;

a pin projecting outwardly from the axial surface; and an arm attached to an end of the pin opposite the vane and comprising a single outer end;

a first ring attached to a portion of the turbocharger and comprising a plurality of openings, wherein the vanes are rotatably mounted on the first ring by engagement of the pins within the openings; and a second ring disposed within the turbocharger and positioned adjacent the first ring, the second ring being rotationally movable relative to the first ring and including a plurality of slots, each vane arm outer end being disposed within a respective slot;

wherein the inner airfoil and outer airfoil surfaces define a camberline positioned therebetween and extending from the leading edge to the trailing edge, wherein the camberline includes a curved section, and is substantially flat along at least about the first five percent of the vane length moving from the leading edge, and wherein the leading edge is defined by a radius of curvature that is in the range of about 10 to 30 percent of the maximum vane thickness; and wherein the vane has a thickness at a location on the vane a distance from the leading edge of approximately three quarters the vane length that is no less than about 40 percent of the vane thickness at a location on the vane a distance from the leading edge of approximately one-half the vane length.

8. The turbocharger assembly as recited in claim 7 wherein the vane camberline is substantially flat along about the first 5 to 40 percent of the vane length moving from the leading edge.

9. The turbocharger assembly as recited in claim 7 wherein the maximum vane thickness is in the range of about 10 to 25 percent of the vane length.

10. The turbocharger assembly as recited in claim 7 wherein the vane has a decreasing thickness moving from a location on the vane a distance from the leading edge of approximately three quarters the vane length to the vane trailing edge.

11. The turbocharger assembly as recited in claim 7 wherein the inner airfoil surface comprises a convex surface portion and a concave surface portion moving from the vane leading edge to the vane trailing edge.

* * * * *